US011020308B2

(12) United States Patent
Swerdlow

(10) Patent No.: US 11,020,308 B2
(45) Date of Patent: Jun. 1, 2021

(54) AMBULATORY AID

(71) Applicant: Aligned As Designed, LLC, Los Angeles, CA (US)

(72) Inventor: Linda Smith Swerdlow, Los Angeles, CA (US)

(73) Assignee: Aligned As Designed, LLC, Los Angeles, CA (US)

( * ) Notice: Subject to any disclaimer, the term of this patent is extended or adjusted under 35 U.S.C. 154(b) by 0 days.

(21) Appl. No.: 15/807,259

(22) Filed: Nov. 8, 2017

(65) Prior Publication Data

US 2019/0133868 A1 May 9, 2019

(51) Int. Cl.
*A61H 3/02* (2006.01)

(52) U.S. Cl.
CPC ..... *A61H 3/02* (2013.01); *A61H 3/0288* (2013.01); *A61H 2003/0211* (2013.01); *A61H 2003/0283* (2013.01); *A61H 2201/01* (2013.01); *A61H 2201/1619* (2013.01); *A61H 2201/1635* (2013.01); *A61H 2201/1645* (2013.01)

(58) Field of Classification Search
CPC ..... A61H 3/02; A61H 2003/0211; A61H 2003/0216; A61H 3/0288; A61H 2201/6145
See application file for complete search history.

(56) References Cited

U.S. PATENT DOCUMENTS 2,417,171 A * 3/1947 McGowan ..... A61H 3/02 135/73
3,040,757 A 6/1962 Smith
3,150,672 A * 9/1964 Johnson, Jr. ..... A61H 3/02 135/73
3,517,678 A * 6/1970 Gilsdorf ..... A61H 3/02 135/72
4,098,283 A 7/1978 Tritle, Jr.
4,135,536 A 1/1979 Willis
4,493,334 A 1/1985 Semanchik et al.
(Continued)

FOREIGN PATENT DOCUMENTS

JP 2008272421 A 11/2008

OTHER PUBLICATIONS

Search Report and Written Opinion dated Feb. 5, 2019 for PCT Application No. PCT/US18/59830, 13 pages.

*Primary Examiner* — David R Dunn
*Assistant Examiner* — Danielle Jackson
(74) *Attorney, Agent, or Firm* — Patterson Thuente Pedersen, P.A.

(57) ABSTRACT

An ambulatory aid, such as a crutch, including a pair of support members connected by a load bearing handle member, and terminating at a first end with a top axilla-conforming member, and a second end with a foot piece. The crutch is used as a straight arm crutch, in which a user's weight is distributed in the hand to keep the arm straight, while preventing any load on the shoulder girdles. The crutches are configured to fit close to the body, to centralize the base of support, and keep the center of gravity lower, thereby keeping the body aligned as designed, and keeping the pectoral and pelvic girdles aligned. Proper body alignment during use results in greater stability and equilibrium of the user compared to traditional "tri-pod" creating crutches.

21 Claims, 6 Drawing Sheets

(56) References Cited

U.S. PATENT DOCUMENTS

| | | | | |
|---|---|---|---|---|
| 4,572,227 | A * | 2/1986 | Wheeler | A61H 3/02 135/72 |
| 5,103,850 | A * | 4/1992 | Davis | A45B 9/04 135/77 |
| 5,139,040 | A | 8/1992 | Kelly | |
| 5,163,710 | A | 11/1992 | Chirtel et al. | |
| 5,167,746 | A | 12/1992 | Sheenan | |
| 5,353,825 | A * | 10/1994 | Davis | A45B 9/04 135/68 |
| 5,411,045 | A * | 5/1995 | Davis | A61H 3/00 135/83 |
| 5,417,234 | A * | 5/1995 | Davis | A45B 9/04 135/68 |
| 5,725,005 | A | 3/1998 | Yamasaki et al. | |
| 5,829,463 | A | 11/1998 | Galan | |
| 6,055,998 | A | 5/2000 | Bader | |
| D442,123 | S | 5/2001 | Johnston | |
| 6,374,841 | B1 | 4/2002 | Yamamoto et al. | |
| 6,527,001 | B1 | 3/2003 | Saldan et al. | |
| 6,851,438 | B2 | 2/2005 | Battiston | |
| D570,094 | S | 6/2008 | Wainwright | |
| D632,476 | S | 2/2011 | Owens et al. | |
| 8,778,031 | B1 | 7/2014 | Latour, Jr. et al. | |
| 9,289,346 | B2 * | 3/2016 | Demski | A61H 3/02 |
| 9,358,176 | B1 * | 6/2016 | Vaeth | A61H 3/02 |
| 9,681,714 | B1 | 6/2017 | Yeh | |
| 9,723,901 | B1 | 8/2017 | Ober et al. | |
| 9,763,848 | B1 | 9/2017 | Handzic et al. | |
| 9,918,893 | B1 * | 3/2018 | Wanderman | A61H 3/02 |
| 9,974,367 | B2 | 5/2018 | Liu | |
| 10,188,183 | B1 | 1/2019 | Swerdlow | |
| 10,206,467 | B1 | 2/2019 | Swerdlow | |
| 2003/0106576 | A1 * | 6/2003 | Tunnell, Jr. | A61H 3/02 135/68 |
| 2004/0144410 | A1 | 7/2004 | Cheng et al. | |
| 2006/0081279 | A1 | 4/2006 | Carlson | |
| 2007/0106397 | A1 | 5/2007 | Townsend et al. | |
| 2008/0035190 | A1 * | 2/2008 | Baker | A61H 3/02 135/68 |
| 2008/0035193 | A1 * | 2/2008 | Baker | A61H 3/02 135/82 |
| 2008/0163914 | A1 * | 7/2008 | Weber | A61H 3/02 135/68 |
| 2008/0173340 | A1 * | 7/2008 | Robbins | A61H 3/00 135/72 |
| 2009/0255562 | A1 | 10/2009 | Ruddy | |
| 2010/0229903 | A1 | 9/2010 | Ozuna et al. | |
| 2012/0167933 | A1 | 7/2012 | Vegvary | |
| 2013/0152986 | A1 | 6/2013 | Hunter | |
| 2013/0180558 | A1 | 7/2013 | Weber et al. | |
| 2013/0263901 | A1 * | 10/2013 | Severson | A61H 3/02 135/72 |
| 2014/0116484 | A1 * | 5/2014 | Demski | A61H 3/02 135/71 |
| 2014/0332045 | A1 | 11/2014 | Rudin | |
| 2016/0150859 | A1 | 6/2016 | Osman | |
| 2016/0151229 | A1 * | 6/2016 | Varghese | A61H 3/02 135/71 |
| 2017/0181918 | A1 * | 6/2017 | Weber | A61H 3/0277 |

* cited by examiner

AMBULATORY AID

TECHNICAL FIELD

The present application relates generally to ambulatory aids, and more specifically to crutches. The present application is related to U.S. application Ser. No. 15/713,036, filed Sep. 22, 2017, and entitled "Ambulatory Aid," which is incorporated herein by reference in its entirety.

BACKGROUND

The human body is a biological movement machine designed to maintain a centralized center of gravity inside its base of support (hereinafter "BOS"). Skeletal bones of the body form the framework, while skeletal muscles move the framework. Tendons found at the ends of skeletal muscles attach the skeletal muscles to the skeletal bones and help maintain the postural alignment of the body. Ligaments attach bone to bone, and have a limited amount of flexibility in order to maintain the attachment of the skeletal bones in the framework.

The articulating bones of the body that form joints stay aligned and positioned properly using skeletal muscles, ligaments, tendons, and fascia. Locomotion that keeps the joints aligned as designed and inside the body's natural BOS also keeps the skeletal muscles and fascia strong and flexible, and helps the body produce synovial fluid. Synovial fluid lubricates, shock absorbs and reduces friction on joints. It also brings nutrients to joints and removes carbon dioxide and metabolic waste.

The hip, knee, and ankle joints are the major peripheral weight bearing joints of the body. The shoulder, elbow, and wrist joints are the major non-weigh bearing peripheral joints of the body. The body has postural equilibrium and stability when the spine is neither angled nor displaced along any of its curves and the weight of the body is distributed upon the major peripheral joints that are intended to bear weight. A vertical line can be drawn from the top of the head to the bottom of the feet.

When the major peripheral joints of the human body are in postural alignment during locomotion, the body stays within its BOS and maintains a low center of gravity (hereinafter "COG"). The upward support force from the BOS aligns with the downward force of gravity. The stability of the body during locomotion depends on the gravitational balance and stability of the spine, arms, and legs. Injury or repetitive movement of a major peripheral joint outside of the body's natural BOS creates overloading or under loading to all other joints due to the redistribution of forces. Under loading or over loading of a joint or movement that causes hyperextension of a joint or its supporting tissue can result in a loss of physical stability and postural alignment. Overtime, repetitive movement that doesn't maintain the body's COG over its base can result in physical and functional disability. The Specific Adaptation to Imposed Demands ("SAID") principle states that the body will gradually adapt to stresses and overloads to which it is subjected. Wolff's Law states that bone function changes cause bone structure modification. Davis's Law states that soft tissue's tendency is to shorten and contract unless subject to frequent stretching; in other words, and to quote Dr. Davis, "[u]se it or lose it." Hook's Law states that tissue strain is directly proportional to applied compressive or stretching stress so long as tissue elasticity is not exceeded.

The general principles of balance and stability include the following:

1. Gravity intersects the BOS of the subject;
2. Anything that decreases the BOS decreases stability of the subject;
3. The lower the COG above the BOS, the more stability of the subject;
4. Objects that have more mass over or near the COG tend to be more stable;
5. The farther the COG intersection line is from the edge of the BOS, the more stable the subject;
6. Stability is directly proportional to the area of the BOS on which a body rests;
7. Stability in a given direction is directly proportional to the horizontal distance of the COG from the edge of the BOS;
8. When two objects have a different shape, but an equal mass, the one with the wider base will be more stable;
9. The further the COG is from the direction of movement, the more likely it is to maintain stability;
10. When a body has balance and physical stability, it has equilibrium, and the COG is inside the BOS;
11. When the BOS is widened in the direction of the line of force (hereinafter "LOF"), the body has greater stability. When the BOS is widened laterally on one side of the body, the COG move closer to the edge and the body has less stability; and
12. Postural stability occurs when the COG and the LOF are over the center of pressure (COP).

Now, relating these principles to walking, during the normal gait cycle the arms as well as the rest of the body stay within the body's natural BOS to maintain the body's balance. The heel makes contact with the ground before the rest of the foot. The body's COG is over and inside its BOS. The shoulder and hip joints maintain vertical orientation and alignment with the pectoral and pelvic girdles. After the heel contacts the ground, the rest of the foot rolls onto an over the ground. The body's weight then passes over its COG as the heel lifts off the ground and the body moves forward. When the gait cycle has reciprocal movement, the shoulder, hip, knee and ankle joints work together to load the weight of the body over and on the foot within the body's BOS. The head stays positioned over the body and the line of sight is in the direction the person is moving.

During locomotion, the human foot has two functions. First, during the stance phase of the gait cycle the foot acts as a mobile adaptor and shock absorber to maintain the body's balance and physical stability on uneven surfaces or terrain. Second, during the swing phase of gait the foot lifts off the ground completely and acts as a lever to propel the body forward. A lever is a rigid bar resting on a pivot, used to help move a heavy or fixed load with one end when pressure is applied to the other.

The human body needs to be aligned as designed during locomotion to maintain or to regain the strength, length, and flexibility of skeletal muscles, tendons, and fascia that align and position the spine and peripheral joints of the body for upright movement. The functional system and human movement known as the sensorimotor system involves sensory and motor activity. Homeostasis is the continuous adaptation and change in response to internal systems within the body and to motion and environmental factors that cause perturbation to the equilibrium and stability of the body. Proprioceptors are internal receptors located in and around muscles, tendons, and joints. The input or afferent messaging that the brain receives from proprioceptors, visual and vestibular input determines the quality of the efferent motor responses that the body receives from the brain. Balance, postural stability, and cognitive processing speed during locomotion are dependent upon postural stability, skeletal muscle strength, and the quality of the quantity of sensory feedback from the brain. Postural orientation of the head and line of sight during locomotion determines the size of a person's visual field and the quality of the quantity of visual, proprioceptor, and vestibular input. When a person's head and line of sight are positioned towards the ground during locomotion, the size of their visual field is small and their postural stability, balance, spatial orientation, depth perception, as well as cognitive processing speed are diminished.

The size, shape, and alignment of traditional and forearm crutch feet are too small and too linear shaped to maintain the body's weight, postural stability, and vertical orientation during locomotion. The user's arms must extend forward and away from the body's center of mass (hereinafter "COM") towards the direction of movement, outside of the BOS to form a tripod between the user and the crutches to maintain balance. The positioning of the arms away from the body's COM changes the arms as well as the legs partial COGs and partial gravity lines. The part of balance that is contributed by each of the arms and legs is called segment's partial equilibrium. Each segment has its own partial COG and partial gravity line. Any change in position of a partial COG produces a corresponding change in the common COG and the LOG in the body. Movement that maintains the vertical LOG of the body and the postural equilibrium of the spine, arms, and legs during locomotion keeps the body's COG low and the COM centralized inside the body's BOS.

When using traditional crutches, the positioning of the arms outside and away from the body's BOS forces the size of the step as well as the stride to increase. The increased step and the stride, as well as the positioning of the arms, draws the head, line of sight, and spine forward towards the ground away form the direction of movement. The positioning of the head and spine, as well as the weight of the body being carried by the shoulder joints during locomotion, creates functional and physical misalignment of the spine, pelvic girdles, and pectoral girdles. Prolonged crutch use causes misalignment of the cervical, thoracic, and lumbar curves of the spine and forces the weight of the body to be redistributed onto the non-weight bearing peripheral joints that were not intended to bear weight during locomotion. Traditional crutches cause mechanical stress and misalignment of the body by forcing the shoulder joints to continuously bear weight beyond their capacity during locomotion. Prolonged mechanical stress of a joint disrupts homeostasis of the body and sets in motion a physiological process (SAID Principle) that will thicken and harden the overloaded bones, joints, and supporting muscles, while weakening and thinning the under loaded and underused bones, muscles, and connective tissue that supports them.

Synaptic reorganization is the body's ability to adjust to changing motor environments. When the spine is misaligned during locomotion, the body's synaptic reorganization is diminished. Prolonged dysfunctional movement patterns force the skeletal muscles and joints to move in ways that they were not designed to move. This results in breakdown of the articular, neural, and muscular systems of the body.

There remains a need for an ambulatory aid or crutch having a structure and cane foot that more closely vertically aligns the body and functions to mirror the normal gait cycle of the musculoskeletal system.

SUMMARY

In embodiments, an ambulatory aid, such as a crutch, generally comprises a pair of support members connected together by a load bearing handle member extending between the support members. The crutch includes, at a first end of the pair of support members, a top axilla-conforming member, and at a second end of the pair of support members, a foot piece. The crutch is designed to be used as a straight arm crutch, in which a user's weight is distributed in the hand to keep the arm straight, while preventing any load on the shoulder girdles. The crutches are configured to fit close to the body to centralize the BOS, and keep the COG and VLOG lower. This configuration imparts the mechanical advantages of keeping the body aligned as designed, forcing smaller steps during use, and keeping the pectoral and pelvic girdles aligned. Such body alignment results in greater stability and equilibrium of the user compared to traditional "tri-pod" creating crutches.

In embodiments, the elongate support members have a low-profile or flattened non-tubular cross section, while curving along their length. The support members are spaced at a first lateral distance at a top end of the members, and then curve toward one another at a bottom portion of the members such that they are spaced at a second lateral distance less then the first lateral distance. The support members have a non-tubular, low profile cross-section, such that the cross-section is non-circular, such as oval-shaped or rectangular, with linear, convex, or concave edges. The flattened, low-profile cross section allows the support member to fit under the arm and near the body. The support members can be formed of metal, carbon fiber, plastic, composite materials, or any combination thereof.

In embodiments, the support members are adjustable at a bottom portion thereof to accommodate the arm and leg height of a user. This can be accomplished, for example, by providing an adjustable elongate member extending parallel to and between the bottom portion of the support members. The elongate member includes structures defining a plurality of apertures along its length. An adjustable member, such as a bolt or screw, can extend through and between an aperture formed in each support member and one of the plurality of apertures of the third member. Adjusting the height simply requires loosening or removing the fastening member from the apertures of the support member and the elongate member, sliding or adjusting the elongate member with respect to the support members, and fastening the adjustable member in a different aperture of the plurality of apertures.

A non-load bearing top member connects and covers the support members at the top ends of the support members. The top member is configured to fit under and conform to a subject's arm and laterally extends and connects the support members, and is formed of a flexible rubber or similar mesh material that is coupled to and covers the top ends of the support members. The top member is arcuate in shape and is defined by a central concave portion flanked by two peripheral portions, the central portion having a width that is smaller than each of the two peripheral portions. The flexible, arcuate top member is configured to conform to the shape and contours of the axilla and underarms to keep the shoulder girdles aligned.

In embodiments, the central portion of the top member extends downward to below where the elbows of a subject would be positioned, and can include one or more openings. The openings are shaped to accommodate a thin gel ice/heat pack, a thin memory foam insert, or both. Additionally or alternatively, the opening can include an internal pocket or pockets into which the user may place personal items such as a thin or small wallet or phone.

A load bearing handle member extends laterally between and connects the support members at a position spaced below the top member. In embodiments, the handles are formed of a thick flexible rubber or similar material to cushion and protect the 29 bones and joints of the hand. The material should have a sufficient balance of flexibility or cushioning to provide comfort to the user, and resilience to provide opposing or counterforce to the downward force applied by the user. In embodiments, the handle member is curved slightly upward toward the ventral or anterior side of the body to keep a user's arms aligned under and with the shoulder girdle and scapula. The handle member is adjustably positionable between the support members so that the user's arms are substantially straight during using, and the handle member bears the user's weight.

In embodiments, the foot piece of the crutch extends from a bottom end of the third elongate member. The foot piece is elongated and extends anterior and posterior from the support members. In a particular embodiment, an anterior portion of the foot piece is longer than the posterior portion. The bottom and sides of the foot piece are tubular or arcuate in shape. In other words, a surface contacting portion of the foot piece is non-planar, but is instead curved or arcuate, allowing the foot piece to roll onto and over a surface during the gait cycle, thereby mimicking the heel to toe motion of the normal gait cycle. In one embodiment, the foot piece is formed of an interior and a tubular rubber exterior, optionally with one or more ridges extending form its exterior surface to provide friction and additional stability.

Crutches according to embodiments are designed to maintain the user's vertical orientation and postural stability without extending the arms or using the underarms and shoulder joints to maintain the weight and vertical stability of the body during locomotion. The axilla (upper part of the arms and sides of the chest) forms an important passage for nerves, blood, and lymph vessels. The shoulder joints and the axilla are not anatomically designed to bear the weight of the body during locomotion, which traditional crutches cause them to do. The design of the crutches of embodiments of the present disclosure allows the user's underarms to align and conform to the natural curves of the body and puts more of the user's weight in the arms and hands. This is done to help maintain the alignment of the skeletal muscles that position and align the shoulder joints and the shoulder girdle.

Stability of a person or object is directly proportional to the alignment of the COG over the area of the BOS on which a body rests. During the swing phase of the gait cycle, traditional crutch shafts become more horizontal than vertical and the small anterior edge of the crutch's feet as well as the user's underarms and shoulder joints are forced to maintain the body's balance, weight, and vertical orientation. The larger size, shape, and surface area of the crutch's feet, as well as its orientation in relation to the crutch shaft and positioning of the user's underarms next to the body keeps the crutch shafts more vertically aligned during locomotion. the front portion of the crutch's foot piece, and not just the front edge, maintains contact with the ground during the swing phase of the gait cycle, helping the user to maintain more of their weight on the crutch fee and a smaller more normal step and stride than with traditional crutches. The positioning of the arms close to and under the shoulder girdle during locomotion gives the user a mechanical advantage and maintains a shorter distance between the hip joint's line of axis when standing and during locomotion. The positioning and size of the crutch foot piece keeps the wrists, arms, and shoulder joints from hyperextending forward outside of the body's BOS, and towards the direction of locomotion. When using the crutches according to embodiments, the orientation of the underarms close to the body helps to maintain the body's vertical orientation, the alignment of the spine, and the bottom of the scapula with the shoulder girdle. The user's head and neck maintain postural alignment over the body. The cervical, thoracic, and lumbar curves of the spine maintain their alignment over each other and with the pelvic and pectoral girdles during the gait cycle.

The head needs to maintain vertical orientation during locomotion to maintain postural alignment and stability with the rest of the body. The relationship between the size and orientation of the crutch feet, support shafts, and top of the crutches, i.e. top member, gives the user more physical and postural stability. The COG, LOG, and the COP are more centralized over the body's BOS during locomotion then with traditional crutches. The crutch design according to embodiments allows the user to keep their head in postural alignment with the rest of their body, and their line of sight, toes, and heels moving in the direction that they're moving. When the line of sight is in the direction the person is moving in and not down at the ground during locomotion, the body has more sensory and proprioceptor input, balance, and physical stability. The crutches according to embodiments meet a previously unmet need by giving the user a mechanical advantage without reducing the postural alignment and equilibrium of the body during locomotion.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
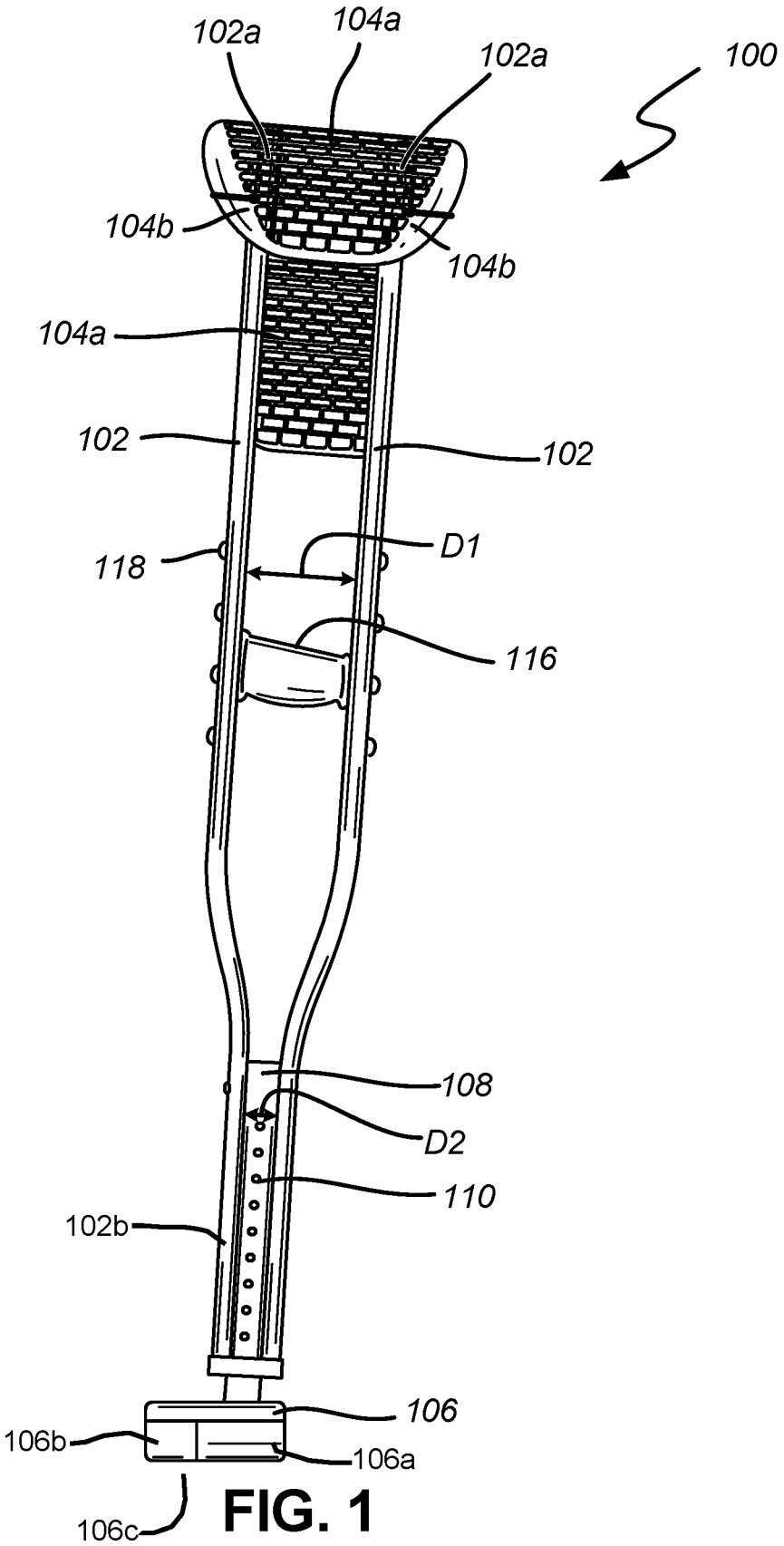
FIG. 1 is a front elevational view of a crutch according to an embodiment.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION

Figure 2:
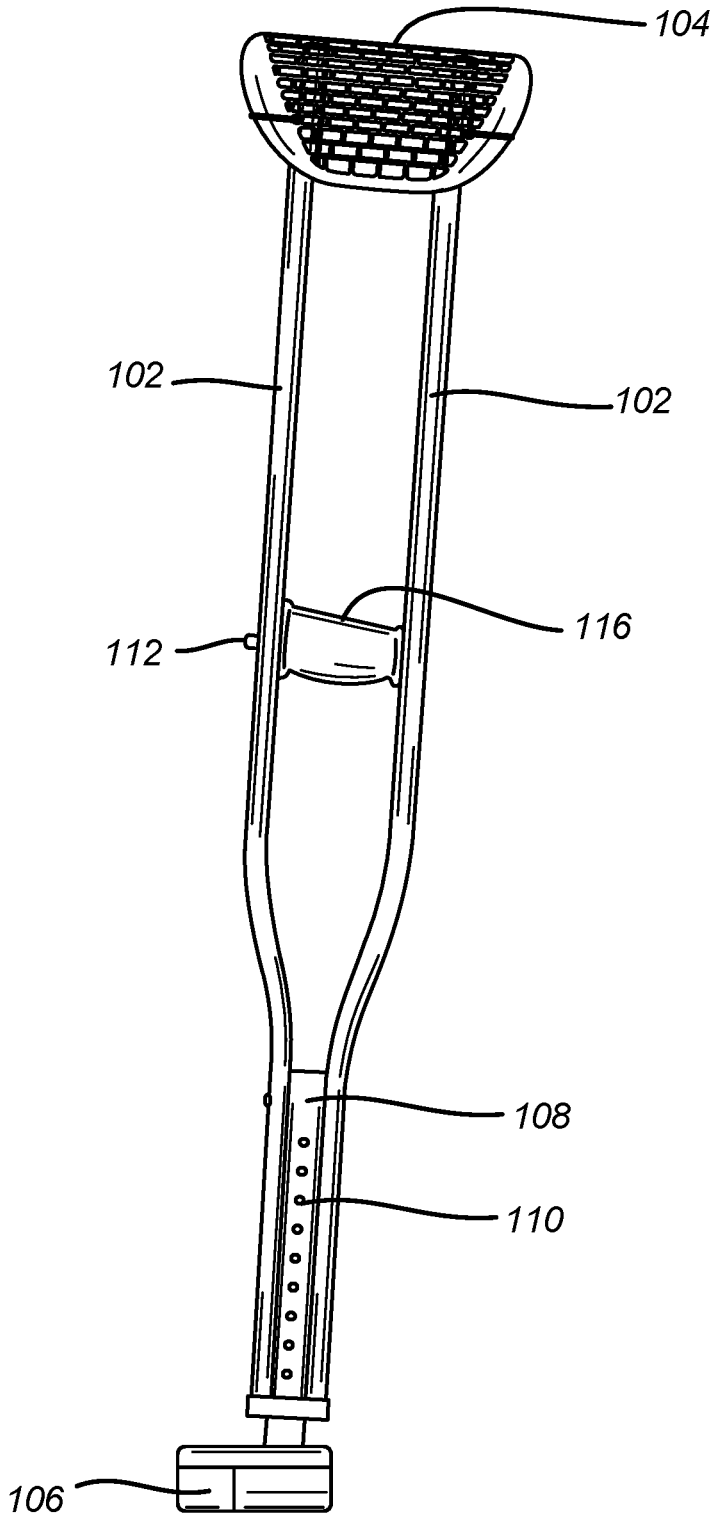
FIG. 2 is a perspective view of a crutch according to an embodiment.

Referring to FIGS. 1 and 2, according to an embodiment, an ambulatory aid 100, such as a crutch, generally comprises a pair of tubular or non-tubular, curved and elongated support members 102, a top member 104 positioned over top ends 102*a* of support members 102, and a foot piece 106 coupled to a bottom portion 102*b* via a adjustable elongate member 108 sandwiched between bottom portion 102*b* of members 102. Support members 102 are spaced at a first lateral distance D1 at a top end 102*a* of members 102, and then curve toward one another at a bottom portion 102*b* of members 102 such that they are spaced at a second lateral distance D2 less then the first lateral distance Dl. Support members 102 can be tubular, such that a cross-section of support members 102 is substantially circular, or can be non-tubular, such that the cross-section is non-circular, e.g., oval-shaped or rectangular. Support members 102 can be formed of metal, carbon fiber, plastic, composite materials, or any combination thereof.

In embodiments, support members 102 are adjustable at least at a bottom portion 102*b* thereof to accommodate the arm and leg height of a user. This can be accomplished, for example, by providing adjustable elongate member 108 extending parallel to and between bottom portion 102*b* of support members 102. Elongate member 108 includes structures defining a plurality of apertures 110 along its length. A fastening member (not shown), such as a bolt, wing nut, or screw, can extend through and between an aperture 114 formed in each support member 102 and one of the plurality of apertures 110 of elongate member 108. Adjusting the height simply requires adjusting or sliding elongate member 108 with respect to support members 102, and fastening the fastening member (not shown) in an aperture 110 of the plurality of apertures 110.

Figure 3:
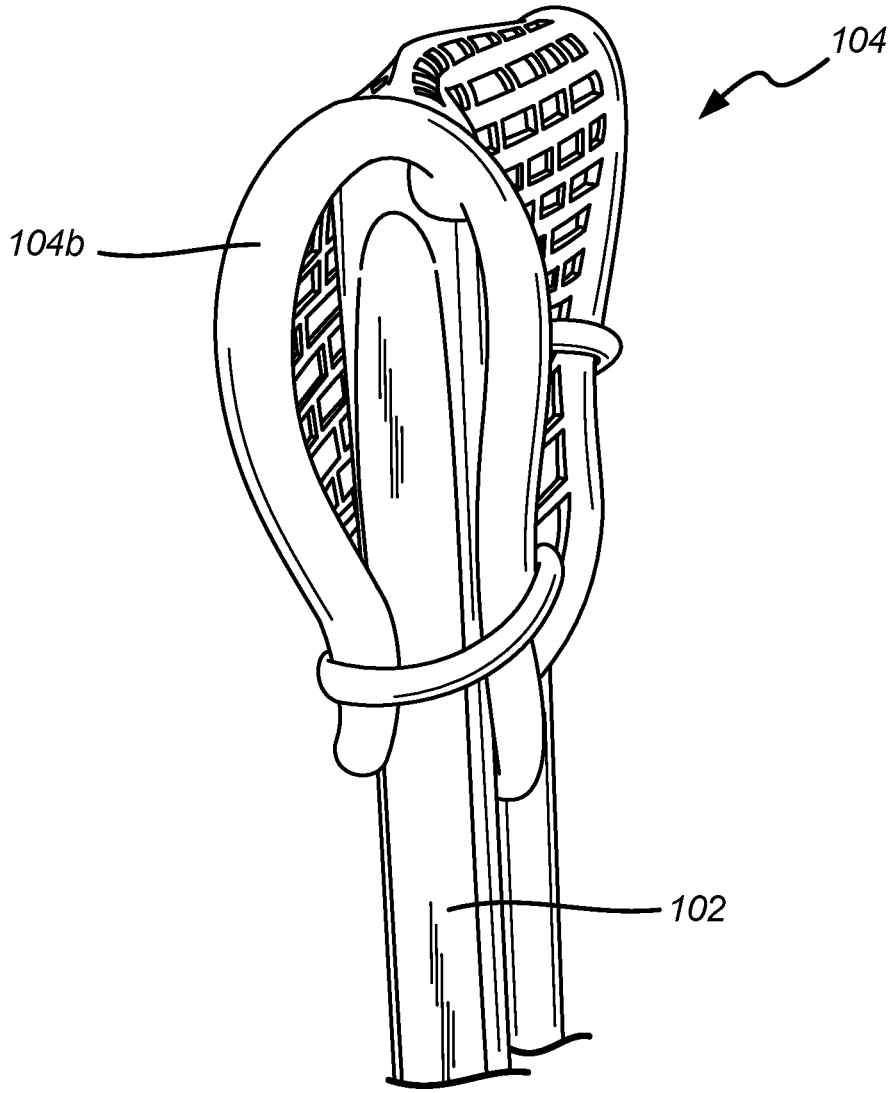
FIG. 3 is a side perspective view of a top member of the crutch of FIG. 1.
Figure 4:
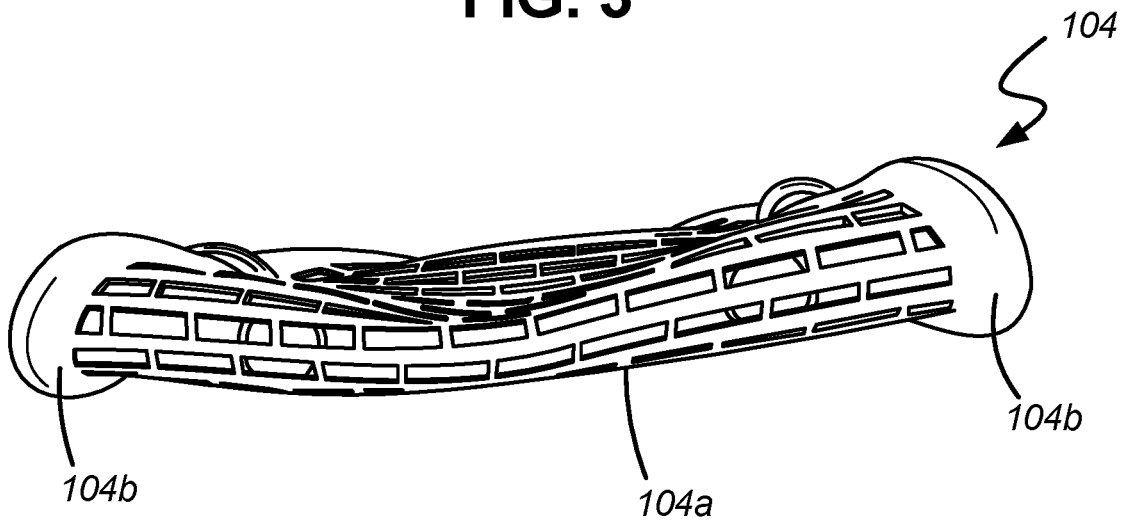
FIG. 4 is front view of the top member of FIG. 3.
Figure 5:
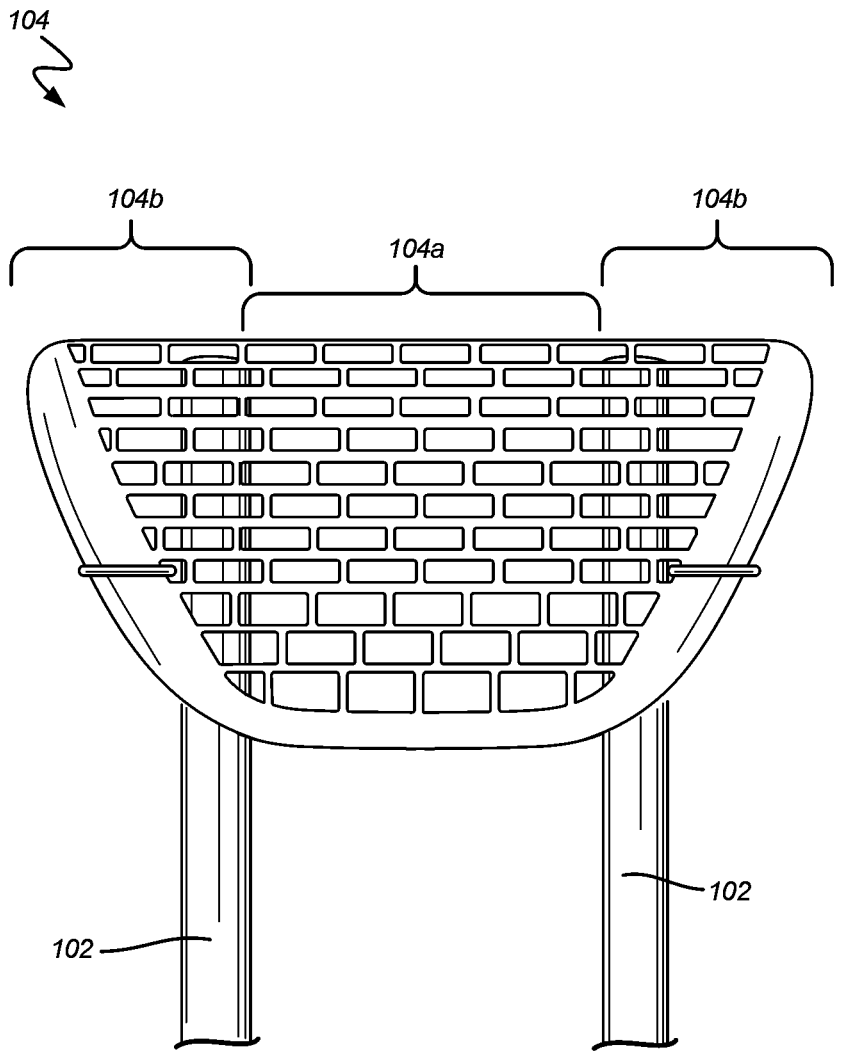
FIG. 5 is a top view of the top member of FIG. 3.

Referring to FIGS. 3-5, top member 104 connects and covers top ends 102*a* of support members 102, and laterally extends and connects support members 102. Top member 104 is formed of a flexible rubber or similar mesh material that is coupled to and covers top ends 102*a*. Top member 104 is designed to be configured to fit under a user's arm. Top member 104 is arcuate in shape and is defined by a central portion 104*a* flanked by two peripheral portions 104*b*, central portion 104*a* having a width that is smaller than a width of each peripheral portion 104*b*. In embodiments, central portion 104*a* has a width of from about 0.3 to about 1.0 inches, and more particularly from about 0.5 to about 0.75 inches. A width of each peripheral portion 104*b* is from about 1 to about 2 inches, and more particularly, does not exceed 1.75 inches. Flexible, arcuate top member 104 is configured to conform to the shape and contours of the axilla and underarms of a user to keep the shoulder girdles aligned.

In embodiments, central portion 104*a* of top member 104 extends downward to below where the elbows of a user would be positioned, and can include one or more openings (not shown). The openings are shaped to accommodate a thin gel ice/heat pack, a thin memory foam insert, or both. Additionally or alternatively, the opening can include an internal pocket or pockets into which the user may place personal items such as a wallet or phone.

Referring back to FIGS. 1 and 2, a handle member 116 extends laterally between and connects support members 102 at a position spaced below top member 104. In embodiments, handle member 116 is formed of a thick flexible rubber or similar material to cushion and protect the twenty-nine bones and joints which make up the hand. The material should have a sufficient balance of flexibility or cushioning to provide comfort to the user, and resilience to provide opposing or counterforce to the downward force applied by the user. In embodiments, handle member 116 is curved slightly upward toward the ventral or anterior side of the body to keep a user's arms aligned under and with the shoulder girdle and scapula.

In embodiments, each support member 102 includes a plurality of corresponding apertures 118 formed on inner and outer sides below top member 104. Handle member 116 also includes an aperture on each end or a single bore hole extending the length of handle member 116. One or more fastening members 112 extend through a pair of corresponding apertures 118 of each member 102, and into the aperture(s) of handle member 116 to fasten handle member 116 to each support member 102. Handle member 116 can be adjusted along the support member 102 by fastening handle member 116 to any pair of the plurality of apertures 118 to accommodate the arm length of a user.

In embodiments, foot piece 106 of crutch 100 is elongated and extends anterior and posterior to elongate member 108 to which it is coupled. In a particular embodiment, an anterior portion 106*b* of foot piece 106 is longer than a posterior portion 106*a*. A total length of foot piece can be from about 3 inches to about 8 inches, and more particularly about 5-6 inches, and more particularly about 5.5 inches. In a particular embodiment, anterior portion 106*b* of foot piece 106 is longer, than posterior portion 106*a* of foot piece 106 when measured from a center point of shaft 102, thereby mimicking the heel and anterior portion of the foot relative to the tibia of the leg. Anterior portion 106*b* can be from about 1.25 to about 3.5 times longer than posterior portion 106*a*. In one particular embodiment, anterior portion 106*b* is 1.75 times longer than posterior portion 106*a*, and can be, for example, about 3.5 inches whereas posterior portion 106*a* can be about 2 inches, when measured from a center point of shaft 102.

A bottom surface 106*c* of foot piece 106 can be tubular or arcuate in shape. In other words, a surface contacting portion 106*c* of foot piece 106 is non-planar, and is curved or arcuate (circular or elliptical), allowing foot piece to roll onto and over a surface during the gait cycle, thereby mimicking the heel to toe motion of the normal gait cycle. In embodiments, a circumference or perimeter (non-circular) varies along the length of foot piece 106, such as from about 4 inches to about 7 inches, and optionally can be wider in areas proximate shaft 102, and then tapering in both the anterior and posterior directions. In other embodiments, a circumference or perimeter of foot piece 106 is substantially constant along anterior portion 106*b*, posterior portion 106*a*, or both. A height of foot piece 106 can be larger on an end of anterior portion 106*b* than an end of posterior portion 106*a*, and can range from about 1 inch to about 3 inches.

In one embodiment, foot piece 106 is formed of an interior material, such as an open-cell foam, closed-cell foam, plastic, or rubber material, and a tubular rubber or silicon exterior cover, optionally with one or more ridges formed thereon, to provide friction and additional stability.

Figure 6:
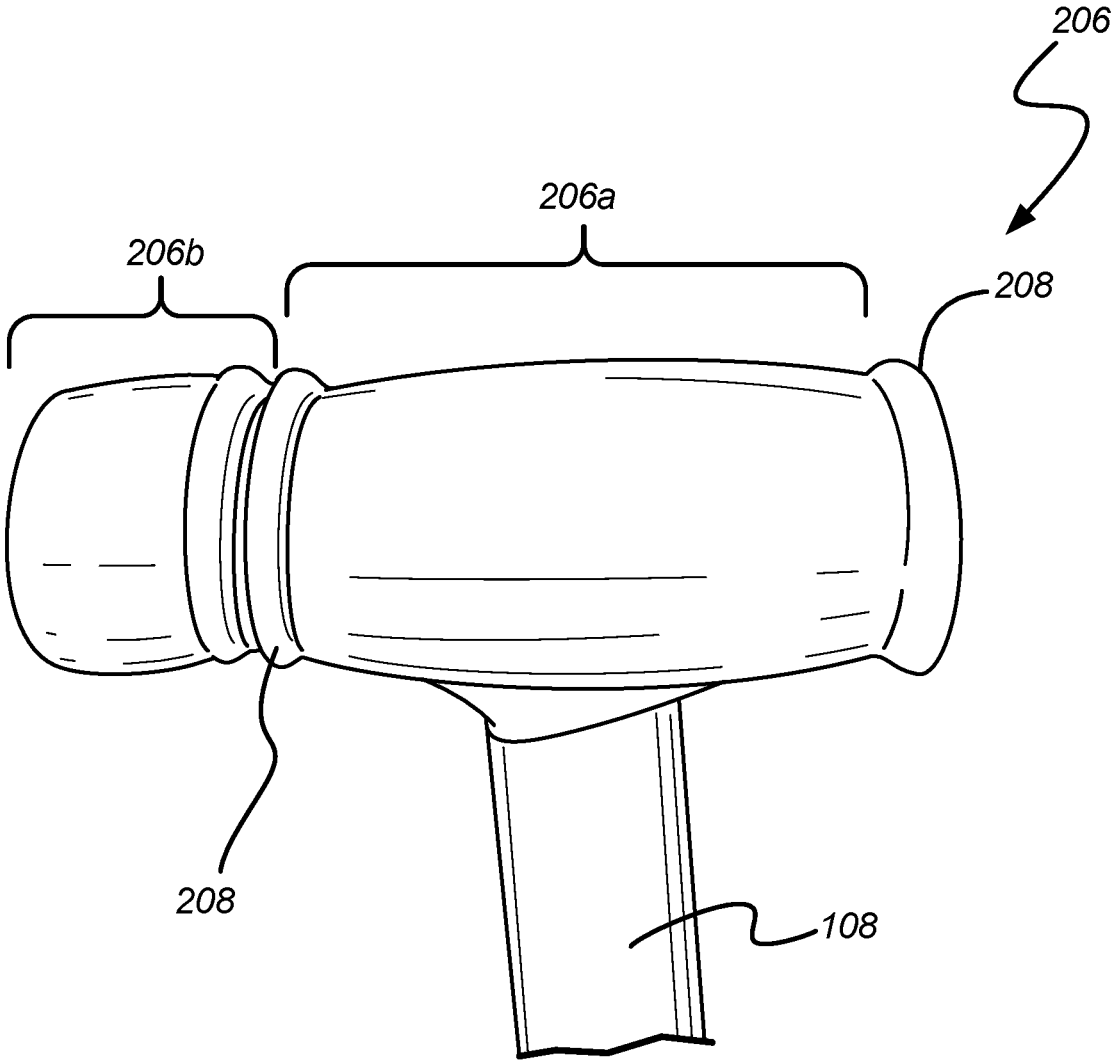
FIG. 6 is a perspective view of a foot piece of a crutch according to an embodiment.
Figure 7:
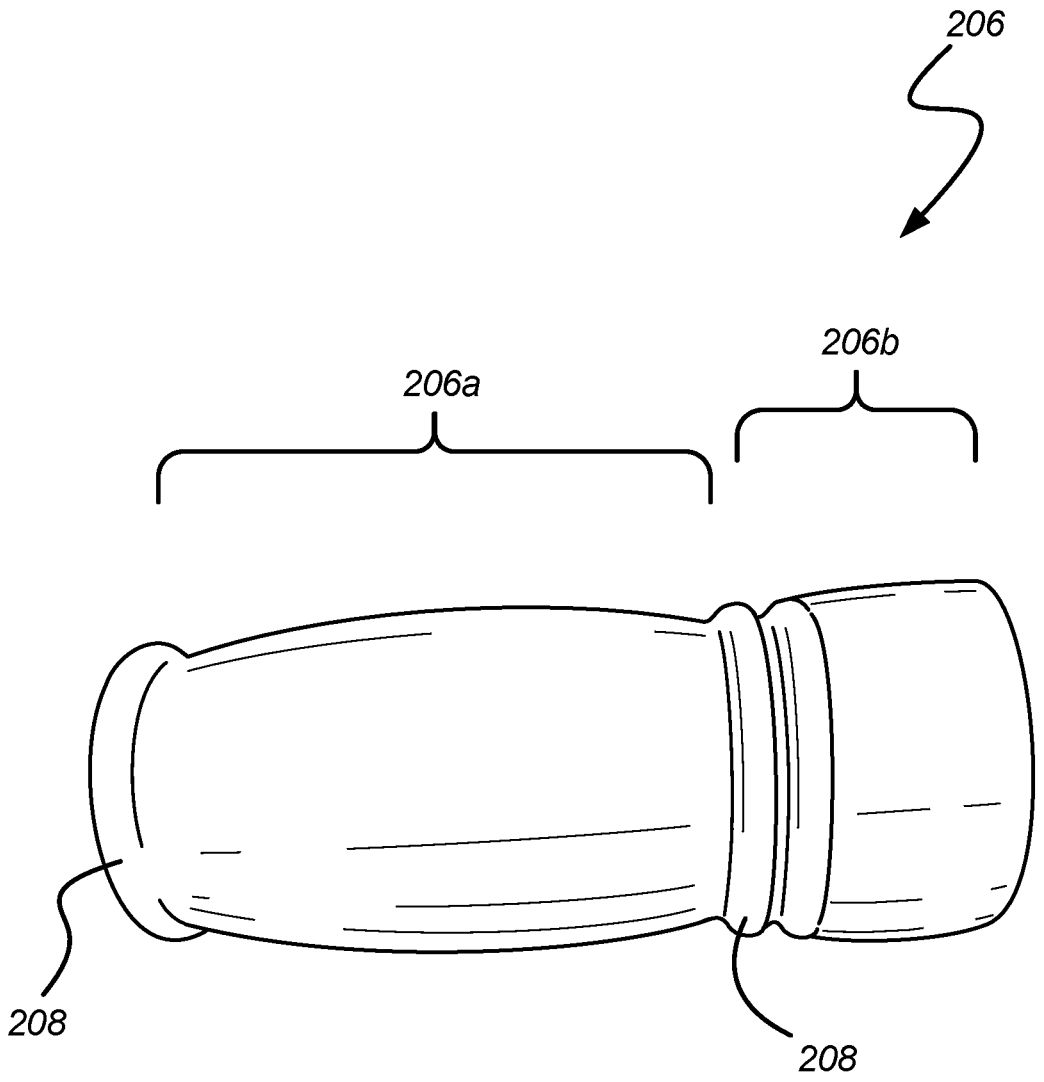
FIG. 7 is a bottom view of the foot piece of FIG. 6.

Now referring to FIGS. 6 and 7, foot piece 206 according to another embodiment includes a first portion 206*a* having a slightly varying diameter along its length, the largest diameter occurring at a central location, and which extends both anterior to and posterior to elongate member 108, and a second portion 206*b*, which has a substantially constant diameter along its length, and extends anterior to first portion 206*a*. A radius of curvature of second portion 206*b* is significantly larger than an average radius of curvature of first portion 206*a*, such that second portion 206*b* appears "flatter" than first portion 206*a*. A ratio of the radius of curvature of second portion 206*b* to first portion 206*a* can be in a range from about 1.25:1 to about 5:1. First portion 206*a* can be separated from second portion 206*b* by one or more ridges 208, and/or can terminate in a ridge 208. Additional ridges can be formed along first portion 206*a* and/or second portion 206*b*, either transversely and/or longitudinally as desired.

As discussed above, crutches according to embodiments are designed to maintain the user's vertical orientation and postural stability without extending the arms or using the underarms and shoulder joins to maintain the weigh and vertical stability of the body during locomotion. The axilla (upper part of the arms and sides of the chest) forms an important passage for nerves, blood, and lymph vessels. The shoulder joints and the axilla are not anatomically designed to bear the weight of the body during locomotion, which traditional crutches cause them to do. The design of the crutches of embodiments of the present disclosure allows the user's underarms to align and conform to the natural curves of the body and puts more of the user's weight in the arms and hands. This is done to help maintain the alignment of the skeletal muscles that position and align the shoulder joints and the shoulder girdle.

Stability of a person or object is directly proportional to the alignment of the COG over the area of the BOS on which a body rests. During the swing phase of the gait cycle, traditional crutch shafts become more horizontal than vertical and the small anterior edge of the crutch's feet as well as the user's underarms and shoulder joints are forced to maintain the body's balance, weight, and vertical orientation. The larger size, shape, and surface area of the crutch's feet, as well as its orientation in relation to the crutch shaft and positioning of the user's underarms next to the body keeps the crutch shafts more vertically aligned during locomotion. the front portion of the crutch's foot piece, and not just the front edge, maintains contact with the ground during the swing phase of the gait cycle, helping the user to maintain more of their weight on the crutch fee and a smaller more normal step and stride than with traditional crutches. The positioning of the arms close to and under the shoulder girdle during locomotion gives the user a mechanical advantage and maintains a shorter distance between the hip joint's line of axis when standing and during locomotion. The positioning and size of the crutch foot piece keeps the wrists, arms, and shoulder joints from hyperextending forward outside of the body's BOS, and towards the direction of locomotion. When using the crutches according to embodiments, the orientation of the underarms close to the body helps to maintain the body's vertical orientation, the alignment of the spine, and the bottom of the scapula with the shoulder girdle. The user's head and neck maintain postural alignment over the body. The cervical, thoracic, and lumbar curves of the spine maintain their alignment over each other and with the pelvic and pectoral girdles during the gait cycle.

The head needs to maintain vertical orientation during locomotion to maintain postural alignment and stability with the rest of the body. The relationship between the size and orientation of the crutch feet, support shafts, and top of the crutches, i.e. top member, gives the user more physical and postural stability. The COG, LOG, and the COP are more centralized over the body's BOS during locomotion then with traditional crutches. The crutch design according to embodiments allows the user to keep their head in postural alignment with the rest of their body, and their line of sight, toes, and heels moving in the direction that they're moving. When the line of sight is in the direction the person is moving in and not down at the ground during locomotion, the body has more sensory and proprioceptor input, balance, and physical stability. The crutches according to embodiments meet a previously unmet need by giving the user a mechanical advantage without reducing the postural alignment and equilibrium of the body during locomotion.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. An ambulatory aid comprising:

a pair of elongate support members, each support member having an arcuate shape;

a non-load bearing top member extending over a top portion of each support member and extending between the support members to couple the support members, the top member consisting of a non-load bearing flexible material configured to conform to a user's axilla while preventing any load on the user's shoulder girdles, wherein the flexible material includes a central portion flanked on each side by a peripheral portion, wherein the central portion is arcuate and extends between the support members, the central portion having a variable width along its length, and wherein each peripheral portion extends beyond the support members;

a load bearing handle having a first end coupled to an anterior positioned support member of the support members, and a second end coupled to a posterior positioned support member of the support members, the handle extending between the support members, wherein a top surface of the handle maintains a continuous curve upward toward the anterior positioned support member of the support members; and a foot piece operably coupled to a bottom portion of the support members, wherein the ambulatory aid is configured so that a user's weight is concentrated in the arms and hands during locomotion.

2. The ambulatory aid of claim 1, wherein the pair of elongate support members are separated at a first distance at the top portion, and a second distance at the bottom portion, wherein the first distance is greater than the second distance.

3. The ambulatory aid of claim 1, wherein the foot piece is operably coupled to the bottom portion of the support members via a third elongate member coupled to and sandwiched between the bottom portion of the support members.

4. The ambulatory aid of claim 1, wherein the foot piece comprises a non-planar surface contacting portion configured to roll over a surface.

5. The ambulatory aid of claim 4, wherein a transverse cross-section of the foot piece is semi-circular or semi-elliptical in shape.

6. The ambulatory aid of claim 4, wherein the foot piece comprises a grip covering having one or more ridges defined on the surface contacting portion and extending transverse to a length of the foot piece.

7. The ambulatory aid of claim 1, wherein the foot piece has a non-continuous height along a length of the foot piece.

8. The ambulatory aid of claim 1, wherein the top member is formed of a flexible mesh material.

9. The ambulatory aid of claim 1, wherein the handle member is positioned with respect to the support members such that a user's arm is kept substantially straight in use, and the user's weight is distributed to a hand of the user gripping the handle member.

10. The ambulatory aid of claim 9, wherein a cross-section of each support member is non-tubular such that the support member is configured to fit close to a body of the user, thereby promoting an alignment of a user's pectoral and pelvic girdles.

11. An ambulatory aid comprising:

a pair of elongate support members, each support member having an arcuate shape;

a non-load bearing top member extending over a top portion of each support member and extending between the support members to couple the support members, the top member consisting of a non-load bearing flexible material configured to conform to a user's axilla while preventing any load on the user's shoulder girdles, wherein the flexible material includes a central portion flanked on each side by a peripheral portion, wherein the central portion is arcuate and extends between the support members, the central portion having a variable width along its length, and wherein each peripheral portion extends beyond the support members;

a load bearing handle having a first end coupled to an anterior positioned support member of the support members, and a second end coupled to a posterior positioned support member of the support members, the handle extending between the support members; and an elongate foot piece operably coupled to a bottom portion of the support members, wherein an anterior portion of the foot piece extends beyond the bottom portion at a length greater than a posterior portion of the foot portion, wherein the ambulatory aid is configured so that a user's weight is concentrated in the arms and hands during locomotion.

12. The ambulatory aid of claim 11, wherein the pair of elongate support members are separated at a first distance at the top portion, and a second distance at the bottom portion, wherein the first distance is greater than the second distance.

13. The ambulatory aid of claim 11, wherein the foot piece is operably coupled to the bottom portion of the support members via a third elongate member coupled to and sandwiched between the bottom portion of the support members.

14. The ambulatory aid of claim 11, wherein the foot piece comprises a non-planar surface contacting portion configured to roll over a surface.

15. The ambulatory aid of claim 14, wherein a transverse cross-section of the foot piece is semi-circular or semi-elliptical in shape.

16. The ambulatory aid of claim 14, wherein the foot piece comprises a grip covering having one or more ridges defined on the surface contacting portion and extending transverse to a length of the foot piece.

17. The ambulatory aid of claim 11, wherein the foot piece has a non-continuous height along a length of the foot piece.

18. The ambulatory aid of claim 11, wherein the non-load bearing top member is formed of a flexible mesh material.

19. The ambulatory aid of claim 11, wherein the handle member is positioned with respect to the support members such that a user's arm is kept substantially straight in use, and the user's weight is distributed to a hand of the user gripping the handle member.

20. The ambulatory aid of claim 11, wherein a cross-section of each support member is non-tubular such that the support member is configured to fit close to a body of the user, thereby promoting an alignment of a user's pectoral and pelvic girdles.

21. The ambulatory aid of claim 20, wherein the cross-section is rectangular.

* * * * *